US008845352B2

(12) United States Patent
Aoki et al.

(10) Patent No.: US 8,845,352 B2
(45) Date of Patent: Sep. 30, 2014

(54) CONNECTOR

(75) Inventors: Hiroshi Aoki, Aichi (JP); Osamu Oshita, Aichi (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/883,085

(22) PCT Filed: Dec. 16, 2011

(86) PCT No.: PCT/JP2011/079193

§ 371 (c)(1),
(2), (4) Date: May 2, 2013

(87) PCT Pub. No.: WO2012/086545

PCT Pub. Date: Jun. 28, 2012

(65) Prior Publication Data

US 2013/0267114 A1 Oct. 10, 2013

(30) Foreign Application Priority Data

Dec. 21, 2010 (JP) ..... 2010-285090

(51) Int. Cl.

| | |
|---|---|
| ***H01R 13/62*** | (2006.01) |
| ***H01R 13/506*** | (2006.01) |
| ***H01R 13/629*** | (2006.01) |
| ***H01R 13/627*** | (2006.01) |
| *H01R 43/26* | (2006.01) |

(52) U.S. Cl.

CPC ..... *H01R 13/629* (2013.01); *H01R 13/506* (2013.01); *H01R 13/6272* (2013.01); *H01R 13/6275* (2013.01); *H01R 43/26* (2013.01); *Y10S 439/923* (2013.01); *Y10S 439/953* (2013.01)

USPC ..... 439/304; 439/923; 439/953

(58) Field of Classification Search

USPC ..... 439/378, 304, 310, 923, 953

See application file for complete search history.

(56) References Cited

U.S. PATENT DOCUMENTS 2,313,481 A * 3/1943 Rendano ..... 416/100
3,093,220 A * 6/1963 Modrey ..... 403/408.1

(Continued)

FOREIGN PATENT DOCUMENTS

| | | | |
|---|---|---|---|
| JP | 10-125394 | A | 5/1998 |
| JP | 2002-117932 | A | 4/2002 |
| JP | 2002-359028 | A | 12/2002 |

OTHER PUBLICATIONS

International Search Report for PCT/JP2011/079193 dated Jan. 24, 2012.

*Primary Examiner* — Neil Abrams
*Assistant Examiner* — Travis Chambers
(74) *Attorney, Agent, or Firm* — Kenealy Vaidya LLP

(57) ABSTRACT

A male connector housing has a first projection whose leading end projects backward beyond a rear end of a female connector housing when the male connector housing is placed at a location where the male connector housing starts to fit into the female connector housing, and a first recess that is formed in a leading end of the first projection so that a tip of another rod-shaped member can be inserted; wherein the female connector housing has a second projection that is provided so as to oppose the leading end of the first projection, and a first contact surface that an exterior surface of the middle portion of the rod-shaped member whose tip is inserted into the first recess can contact. The rod-shaped member is utilized as a lever for bringing the male connector housing and the female connector housing into a fit connection.

5 Claims, 7 Drawing Sheets

(56) References Cited

U.S. PATENT DOCUMENTS

| | | | | | |
|---|---|---|---|---|---|
| 4,083,619 | A * | 4/1978 | McCormick et al. | ..... | 439/310 |
| 4,980,800 | A * | 12/1990 | Furuta | ..... | 361/727 |
| 5,106,321 | A * | 4/1992 | Haroutel | ..... | 439/310 |
| 5,316,493 | A * | 5/1994 | Sowers | ..... | 439/346 |
| 6,030,250 | A * | 2/2000 | Sawayanagi et al. | ..... | 439/372 |
| 6,102,717 | A * | 8/2000 | Aoki et al. | ..... | 439/157 |
| 6,183,278 | B1 * | 2/2001 | Hirasawa et al. | ..... | 439/157 |
| 8,172,590 | B2 * | 5/2012 | Zhou | ..... | 439/236 |
| 8,192,221 | B2 * | 6/2012 | Schmettkamp et al. | ..... | 439/345 |
| 2002/0182918 | A1 | 12/2002 | Okabe et al. | | |
| 2007/0009362 | A1 * | 1/2007 | Tseng | ..... | 416/210 R |

* cited by examiner

CONNECTOR

This application is a U.S. national phase filing under 35 U.S.C. §371 of PCT Application No. PCT/JP2011/079193, filed Dec. 16, 2011, and which in turn claims priority under 35 U.S.C. §119 to Japanese Patent Application No. JP2010-285090, filed Dec. 21, 2010, the entireties of which are incorporated by reference herein.

TECHNICAL FIELD

The present invention relates to a connector capable of making a fit connection between connector housings with a low insertion force.

BACKGROUND ART

FIG. 7 shows an example of a related art connector capable of making a fit connection between connector housings with a low insertion force.

A connector 100 shown in FIG. 7 is disclosed in Patent Document 1.

The connector 100 is a so-called lever connector and is equipped with a female connector housing 110 having at a leading end thereof a hood 111 to which its counterpart connector housing is to be fit; a male connector housing 120 that fits into the hood 111; and a lever 130 attached in a turnable fashion to the male connector housing 120.

A middle portion of the lever 130 in its longitudinal direction (a direction of arrow X1 in FIG. 7), is engaged with a fulcrum shaft 121 projectingly provided on the male connector housing 120, thereby being coupled to the male connector housing 120 in a turnable manner. Arrow R1 shown in FIG. 7 denotes a direction in which the lever 130 turns around a fulcrum, or the fulcrum shaft 121.

As illustrated, the male connector housing 120 is positioned to a position where the male connector housing starts to fit into the female connector housing 110 with one end 131 of the lever 130 declined toward the female connector housing 110.

The one end 131 of the lever 130 is provided with protrusions that will engage with un-illustrated recesses formed on the female connector housing 110 when a remaining end 132 of the lever 130 is pushed down and turned around the fulcrum shaft 121. Further, the other end 132 of the lever 130 is provided with a housing push area by way of which the male connector housing 120 is pushed down when the other end 132 is depressed.

In relation to the aforementioned connector 100, after the female connector housing 110 and the male connector housing 120 are positioned at the fit starting position, the other end 132 of the lever 130 is depressed toward the female connector housing 110, whereupon the lever 130 with its one end 131 engaged with the female connector housing 110 acts as a lever member, to thus exert great pushing force on the male connector housing 120. Accordingly, a fit connection between the connector housings can be made with a low insertion force.

RELATED ART DOCUMENT

Patent Document

Patent Document 1: JP-A-2002-359028

SUMMARY OF THE INVENTION

Problem that the Invention is to Solve

Yet, the connector 100 having the lever 130 for use in making a fit connection between connector housings incurred problems; specifically, an increase in the number of constituent parts and the number of fabrication processes, for reasons of the lever 130.

Moreover, when the lever 130 is utilized as a pry, a magnitude of insertion force (pushing force) input to the lever 130 is determined by a leverage. In order to make the insertion force small, making a length of the lever 130 longer to increase the leverage is effective.

However, increasing the length of the lever 130 in order to make the insertion force small causes another problem of the connector being made bigger.

Accordingly, the present invention aims at solving the problem and providing a connector that is capable of making a fit connection between connector housings with an insertion force which is equivalent to or smaller than an insertion force used by a lever connector and without incurring an increase in the number of constituent parts or the number of fabrication processes, and that is also suitable for miniaturization.

Means for Solving the Problem

The object of the present invention is accomplished by the following configurations.

(1) A connector having a pair of a male connector housing and a female connector housing to be fit-connected together, wherein one of the pair of the male connector housing and the female connector housing has a first projection which is projectingly provided along a direction in which connector housings are fitted together in such a way that a leading end of the first projection projects from a rear end of the other connector housing in a rear when the one connector housing is placed at a location where the one connector housing starts to fit into the other connector housing, and a first recess that is formed in the leading end of the first projection so that a tip of another rod-shaped member can be inserted in a direction which crosses a direction in which the connector housings are fitted together; wherein the other connector housing has a second projection that is provided so as to project backward from a rear end of the other connector housing so as to oppose the leading end of the first projection in a direction that is substantially orthogonal to the direction in which the connector housings are fitted together when the other connector housing is positioned at the location where the one connector housing starts to fit into the other connector housing, and a first contact surface that is formed in a leading end of the second projection such that an exterior surface of a middle portion of the rod-shaped member whose tip is inserted into the first recess can contact the first contact surface; and wherein the rod-shaped member whose tip is inserted into the first recess with the exterior surface of the middle portion of the rod-shaped member remaining in contact with the first contact surface while the connector housings are placed at a fit starting position is utilized as a lever for making a fit between the connector housings.

(2) The connector defined in (1), wherein the first projection is mounted so as to project toward a rear end of the other connector housing while penetrating through a shaft insert hole formed, in a piercing manner, in substantially a center of the other connector housing.

(3) The connector defined in (1) or (2), wherein a second recess that allows insertion of the tip of the rod-shaped member in a direction which crosses a direction in which the connector housing are fit-connected together is formed in the leading end of the second projection; a second contact surface that is provided at a leading end of the first projection and that the exterior surface of the middle portion of the rod-shaped member can contact when the tip is inserted into the second recess; and the rod-shaped member, whose tip is inserted into the second recess while the connector housings remain in a fit-connected state, with the exterior surface of the middle portion of the rod-shaped member remains in contact with the second contact surface is utilized as a lever for releasing the connector housings from the fit-connected state.

(4) The connector defined in (1) or (2), wherein the first recess and the first contact surface each are formed so that a driver which is a general purpose tool can be used as the rod-shaped member.

(5) The connector defined in (3), wherein the first recess, the first contact surface, the second recess, and the second contact surface each are formed so that a driver which is a general purpose tool can be used as the rod-shaped member.

By the configuration defined in (1), the rod-shaped member, whose tip is inserted into (engaged with) the first recess while the connector housings remain located at a position where connector housings start to fit connect with each other, with the exterior surface of its middle portion remaining in contact with the first contact surface acts as a lever that pushes the one connector housing into the other connector housing when a base end of the lever is pushed down. As in the case with the lever connector, an insertion force required to bring the connector housings into a fit-connected state can be lessened.

The rod-shaped member is a member which differs from each of the connector housings that make up the connector, and can be handled and utilized as a different tool. The rod-shaped member, as distinct from a leer that is previously accommodated in a connector housing, also does not incur an increase in the number of fabrication processes. Moreover, the rod-shaped member can be handled as a tool differing from the connector housings. Therefore, even when the length of the rod-shaped member is made longer in order to obtain a desired leverage, an increase in the size of the connector is not caused. An increase in leverage makes it possible to make an insertion force much smaller and miniaturize the connector.

Accordingly, a fit connection between the connector housings can be made with an insertion force that is equal to or smaller than that required by the lever connector without incurring an increase in the number of fabrication processes, and miniaturization of the connector can also be sought.

By means of the configuration defined in (2), the first projection penetrates through the substantial center of the other connector housing. During manipulation for causing the rod-shaped member to act as a lever member to thereby make a fit connection between the connector housings, the load that is exerted on the one connector housing by the rod-shaped member in the fitting direction by way of the first projection acts on the substantial center of the one connector housing that is the location where the first projection is mounted.

Therefore, occurrence of an inclination or a twist in the one connector housing is prevented, thereby making it possible to make mutual fitting of the connector housings smooth.

By means of the configuration defined in (3), when a downward push is given to the base end of the rod-shaped member, whose tip is inserted into (engaged with) the second recess while the connector housings remain fit-connected to each other, with the exterior surface of its middle portion remaining in contact with the second contact surface, the rod-shaped member acts as a lever for releasing the connector housings from the fitted state. As in the case with the lever connector, a manipulation force required to release the connector housings from the engaged state can be lessened.

By means of the configuration defined in (4) or (5), a driver that is a general purpose tool is used as the rod-shaped member. Therefore, a necessity to design and manufacture a custom-designed rod-shaped member is obviated, so that an increase in the number of constituent parts of the connector 1 can be prevented.

EMBODIMENT FOR IMPLEMENTING THE INVENTION

A preferred embodiment of a connector of the present invention is hereunder described in detail by reference to the drawings.

Figure 1:
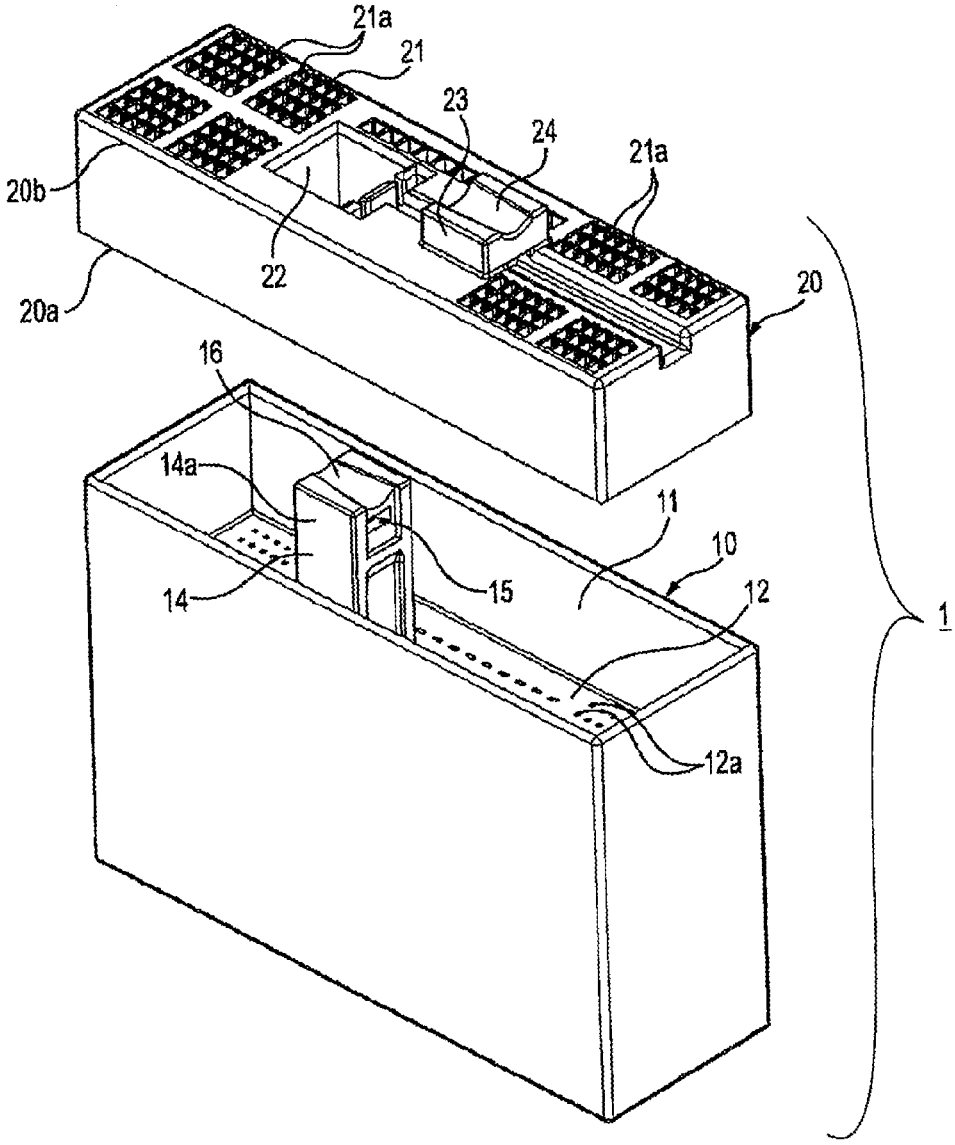
FIG. 1 is an exploded perspective view of an embodiment of a connector of the present invention.

As shown in FIG. 1, a connector 1 of an embodiment has a male connector housing 10 having at a leading end thereof a substantially, rectangularly tubular hood 11 into which its counterpart connector housing fits, and a female connector housing 20 that fits into the male connector housing 10.

A leading end 20*a* is inserted into the hood 11 up to a predetermined depth, whereby the female connector housing 20 is fit-connected to the male connector housing 10.

In the embodiment, the male connector housing 10; specifically, one of the pair consisting of the male connector housing 10 and the female connector housing 20, has a male terminal accommodation section 12, a first projection 14, a first recess 15, and a second contact surface 16.

The male terminal accommodation section 12 has a configuration in which a plurality of terminal accommodation holes 12*a* for accommodating pieces of male terminal hardware are arrayed, accommodating and holding the plurality of pieces of male terminal hardware. The male terminal accommodation section 12 is provided on a rear end side (a deep inside of the hood 11) distant from the food 11.

Figure 2:
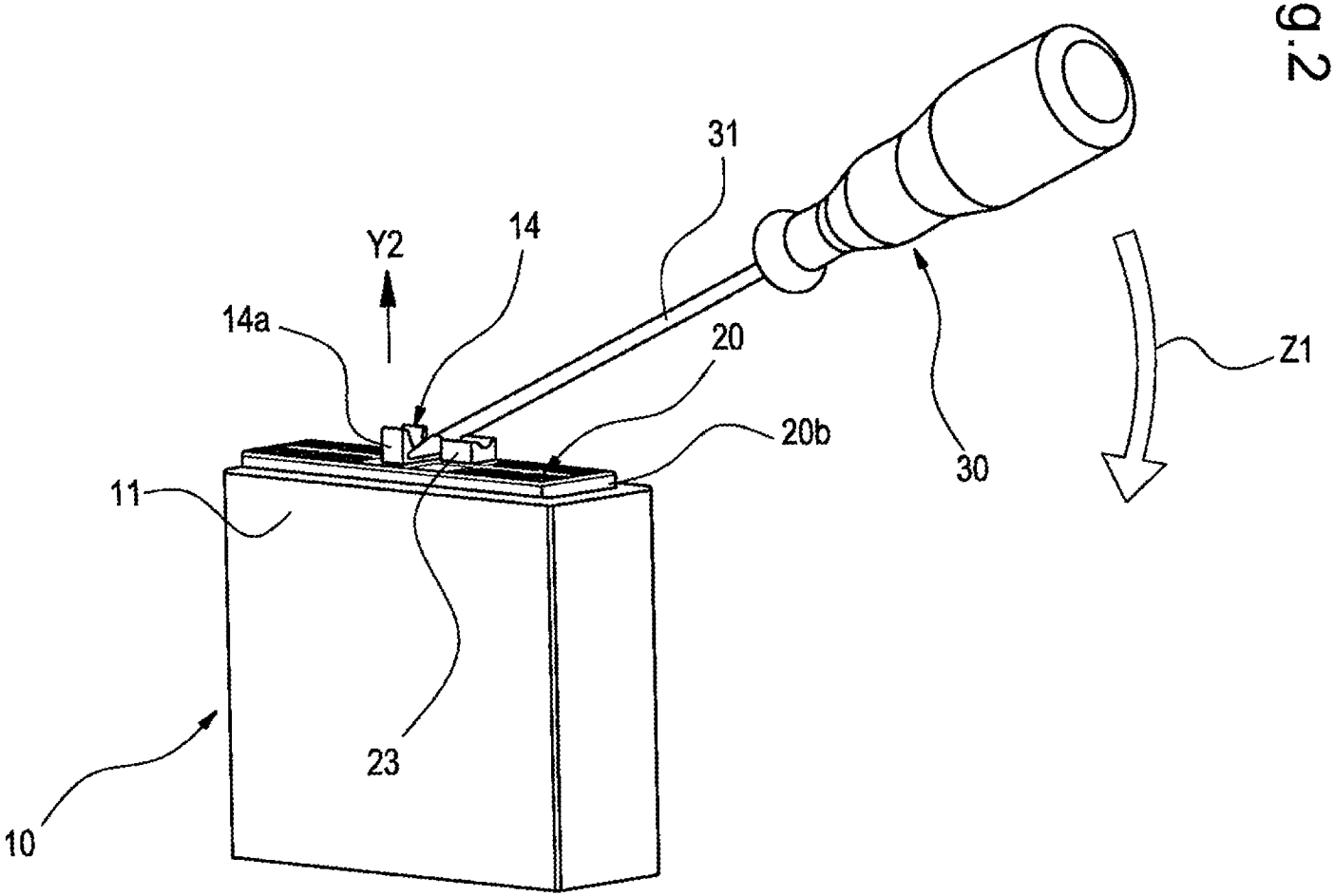
FIG. 2 is an explanatory view of a method for making a fit-connection between connector housings, which are shown in FIG. 1, by means of a rod-shaped member.
Figure 3:
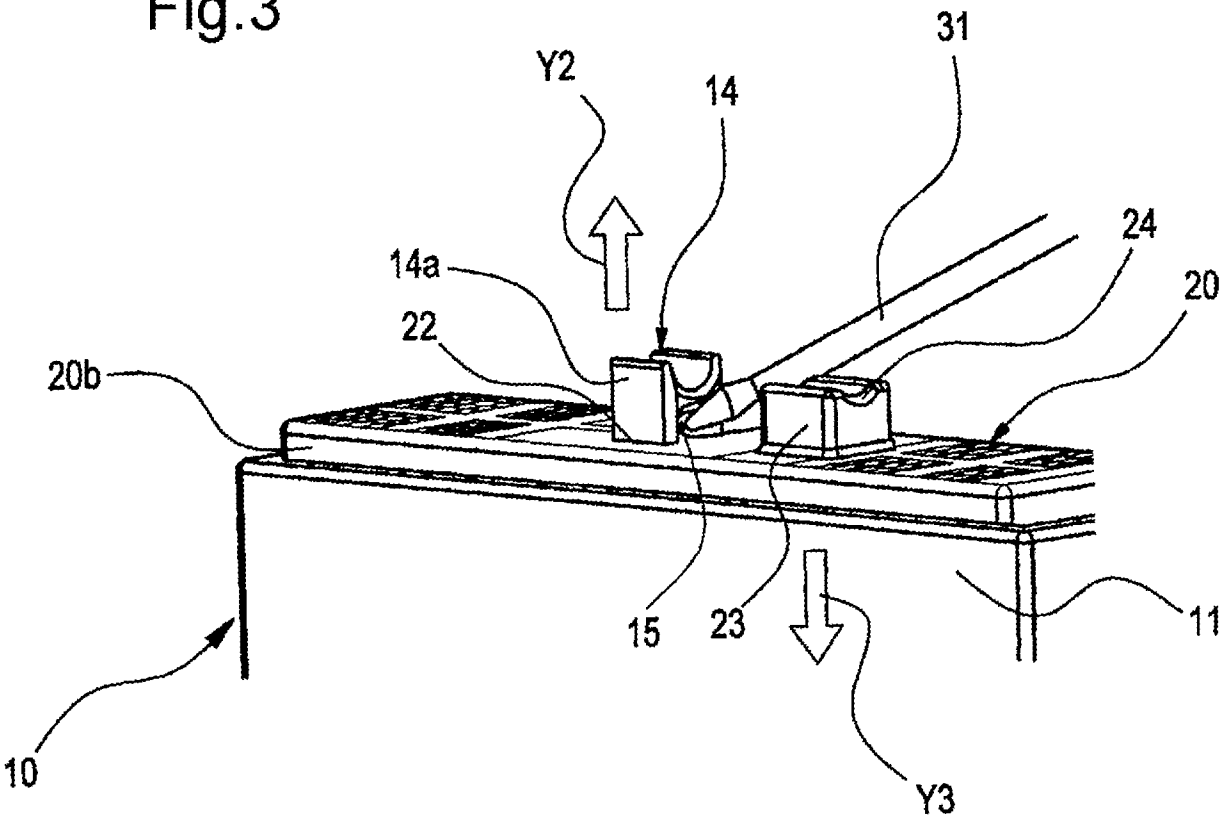
FIG. 3 is an enlarged view of a principal part of the method shown in FIG. 2.

As shown in FIG. 1, the first projection 14 is substantially prismatic and provided in a projecting manner in a direction in which the male connector housing 10 and the female connector housing 20 are fitted together. The first projection 14 stands upright at a substantial center of the male terminal accommodation section 12 of the male connector housing 10. As shown in FIGS. 2 and 3, a projection length of the first projection 14 is set in such a way that a leading end 14*a* projects backward (in direction of Y2 in FIG. 2) a rear end 20*b* of the female connector housing 20 when the leading end 20*a* of the female connector housing 20 is inserted into the hood 11 of the male connector housing 10, and thus the male connector housing 10 is positioned at a location where the male connector housing 10 starts to fit into the female connector housing 20.

As shown in FIGS. 1 and 2, the first recess 15 is a dent formed in the leading end 14*a* of the first projection 14 so as to allow insertion (engagement) of a tip of a shaft 31 of a driver 30 which is a rod-shaped member differing from the male connector housing 10 and the female connector housing 20, in a direction crossing the direction in which the male connector housing 10 and the female connector housing 20 are fitted together.

The second contact surface 16 is formed in a leading end face of the leading end 14*a* of the first projection 14. The second contact surface 16 is one that an exterior surface of a middle portion of the shaft 31 of the driver 30 whose tip is inserted into a second recess 25 (see FIGS. 5 and 6) to be described later can contact. The second contact surface 16 is formed like a trench that hinders the shaft 31 from easily coming out of alignment in a direction orthogonal to an axis.

Figure 6:
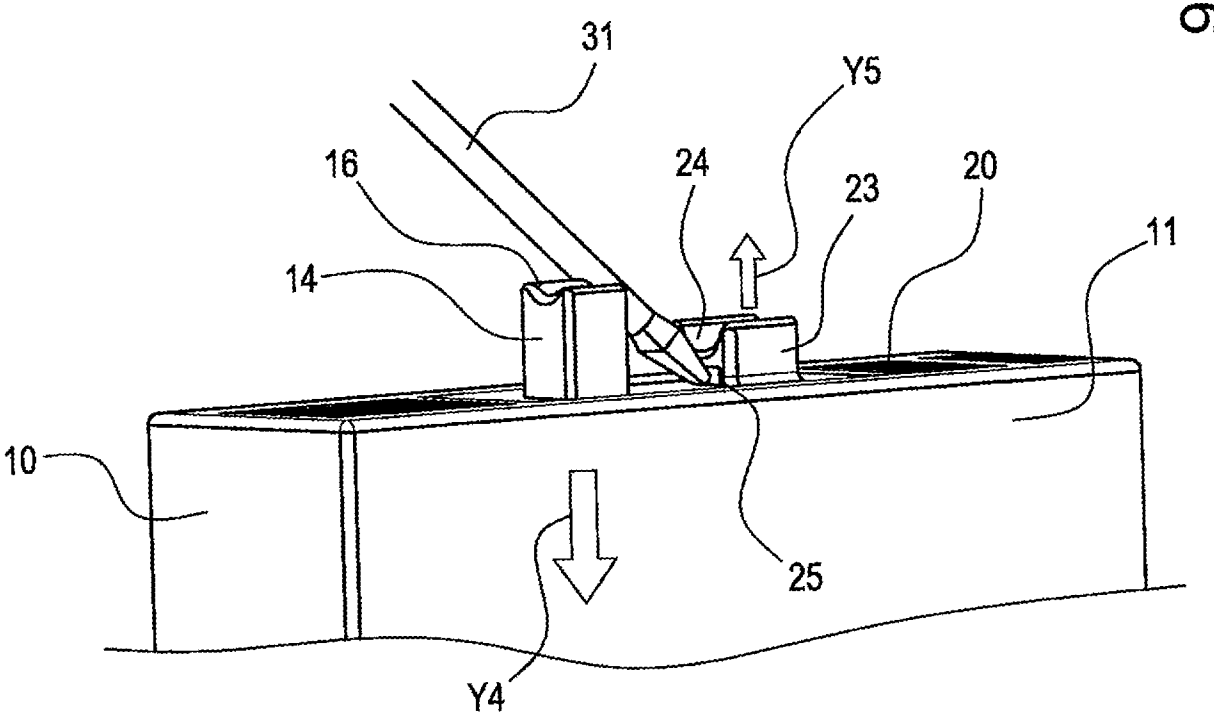
FIG. 6 is an enlarged perspective view achieved when a principal part shown in FIG. 5 is viewed from another view point that differs from a viewpoint used in FIG. 5.
Figure 7:
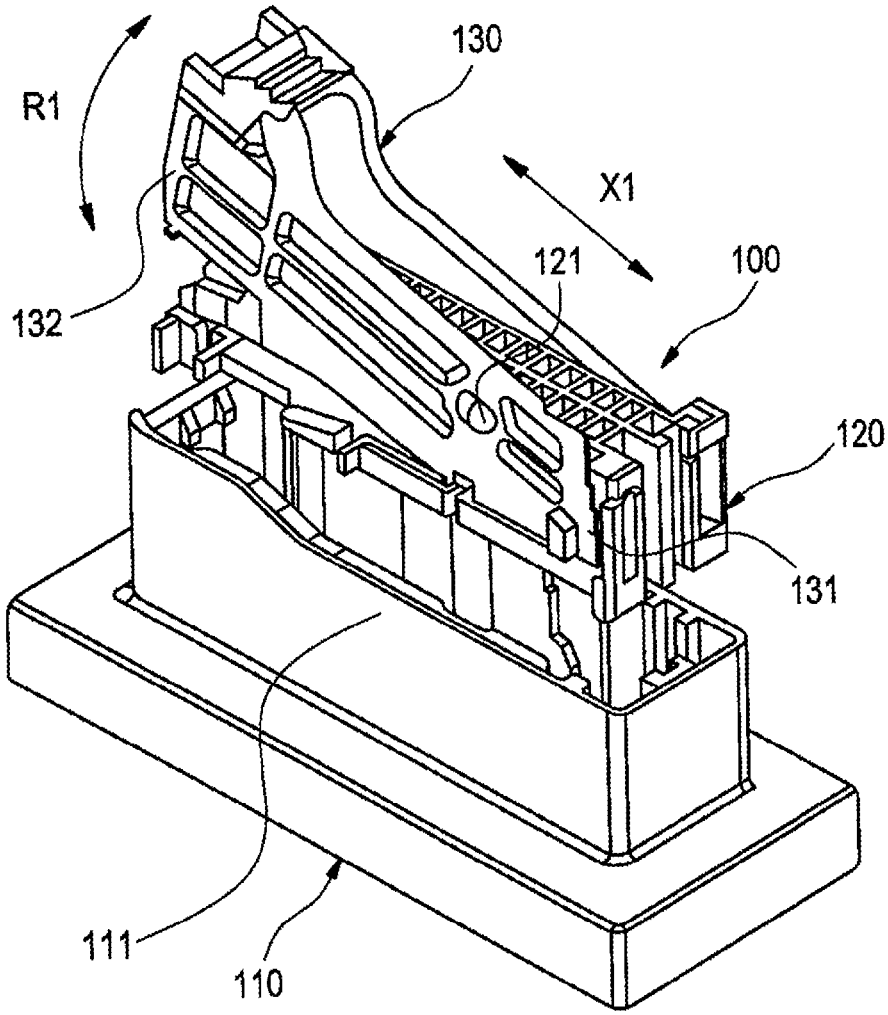
FIG. 7 is an explanatory view of a related art connector that involves a low insertion force.

The female connector housing 20, or the other one of the pair consisting of the male connector housing 10 and the female connector housing 20, has, as shown in FIGS. 1 and 6, a female terminal accommodation section 21 that accommodates and holds a plurality of pieces of female terminal hardware, a shaft insert hole 22, a second projection 23, a first contact surface 24, and a second recess 25.

The female terminal accommodation section 21 has a configuration in which a plurality of terminal accommodation holes 21*a* for accommodating pieces of female terminal hardware are arrayed, accommodating and holding the plurality of pieces of female terminal hardware.

The shaft insert hole 22 is one that permits insertion of the first projection 14 of the male connector housing 10 and that is formed, in a penetrating manner, in a center of the female connector housing 20 in correspondence to a location on the male connector housing 10 where the first projection 14 is mounted.

As shown in FIG. 3, when the male connector housing 10 and the female connector housing 20 are placed at the fit starting position, the first projection 14 of the male connector housing 10 runs through the shaft insert hole 22 of the female connector housing 20, whereupon the leading end 14*a* of the first projection 14 sticks out backward the rear end of the female connector housing 20.

The second projection 23 is disposed in a projecting manner in a substantial center of the rear end 20*b* of the female connector housing 20 so as to project rearward from the rear end 20*b* of the female connector housing 20.

The second projection 23 is placed so as to oppose the leading end 14*a* of the first projection 14 in a direction substantially orthogonal to the direction in which the male connector housing 10 and the female connector housing 20 are fitted together when the female connector housing 20 is placed at the location where the female connector housing 20 starts to fit into the male connector housing 10 as shown in FIG. 2.

The first contact surface 24 is formed on top of a leading end of the second projection 23 so as to allow contacting of an exterior surface of a middle portion of the shaft 31 of the driver 30 whose tip is inserted into the first recess 15. The first contact surface 24 is formed like a trench that hinders the shaft 31 from easily coming out of alignment in a direction orthogonal to an axis.

As shown in FIG. 6, the second recess 25 is a dent that can be inserted into (engaged with) the tip of the shaft 31 of the driver 30 in a direction crossing (substantially orthogonal to) the direction in which the male connector housing 10 and the female connector housing 20 are fitted together. The second recess 25 is placed at a position on a leading end of the second projection 23 that is beneath the first contact surface 24.

Explanations are now given, in sequence, to a method for fit-connecting the male connector housing 10 to the female connector housing 20 and a method for releasing the male connector housing 10 and the female connector housing 20 from a fitted state.

Figure 4:
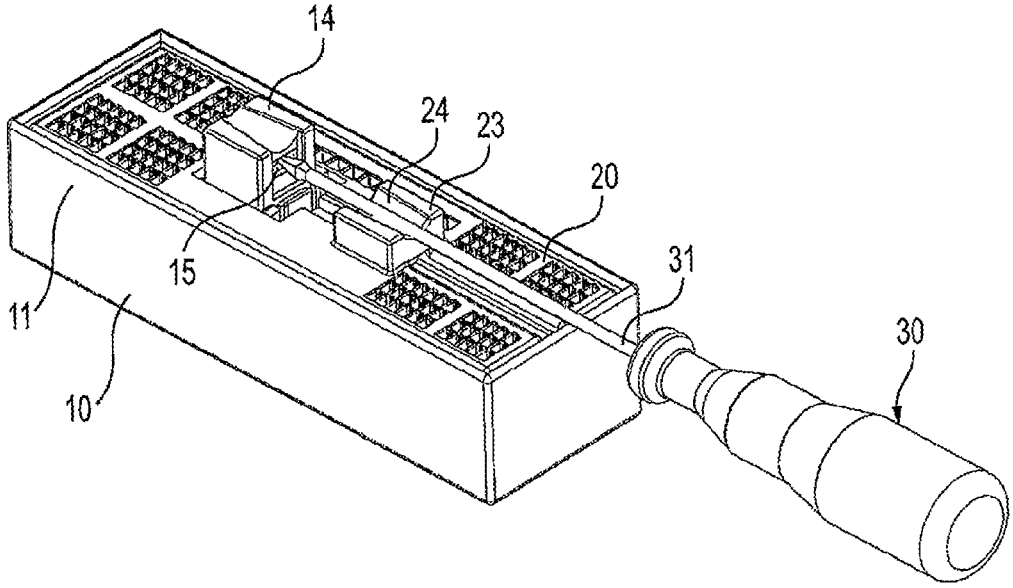
FIG. 4 is a perspective view showing that a fit-connection is completed by actuation of the rod-shaped member.

First, the method for fit-connecting the male connector housing 10 to the female connector housing 20 is described by reference to FIGS. 2 through 4.

As shown in FIGS. 2 and 3, the male connector housing 10 and the female connector housing 20 are placed at the fit starting position. The tip of the shaft 31 of the driver 30 is then inserted into the first recess 15 of the first projection 14 poking out backward the rear end of the female connector housing 20. Moreover, the exterior surface of the middle portion of the shaft 31 is brought into contact with the first contact surface 24 of the second projection 23. In this state, as designated by arrow Z1 shown in FIG. 2, a base end (a grip side) of the driver 30 is pushed downwards.

As shown in FIG. 3, as a result of depression of the driver 30, an upward pull-up load designated by arrow Y2 acts on the first projection 14, and a downward push load designated by arrow Y3 acts on the second projection 23, whereupon the male connector housing 10 and the female connector housing 20 each move in a fitting direction. When the driver 30 comes into a substantially horizontal state shown in FIG. 4, a fit connection between the male connector housing 10 and the female connector housing 20 is completed.

Specifically, in the connector 1 of the embodiment, when the tip of the shaft 31 is inserted into the first recess 15 while the male connector housing 10 and the female connector housing 20 are placed at the fit starting position, the shaft 31 of the driver 30 with the exterior surface of its middle portion remaining in contact with the first contact surface 24 is utilized as a lever for fitting the male connector housing 10 and the female connector housing 20 into each other.

Figure 5:
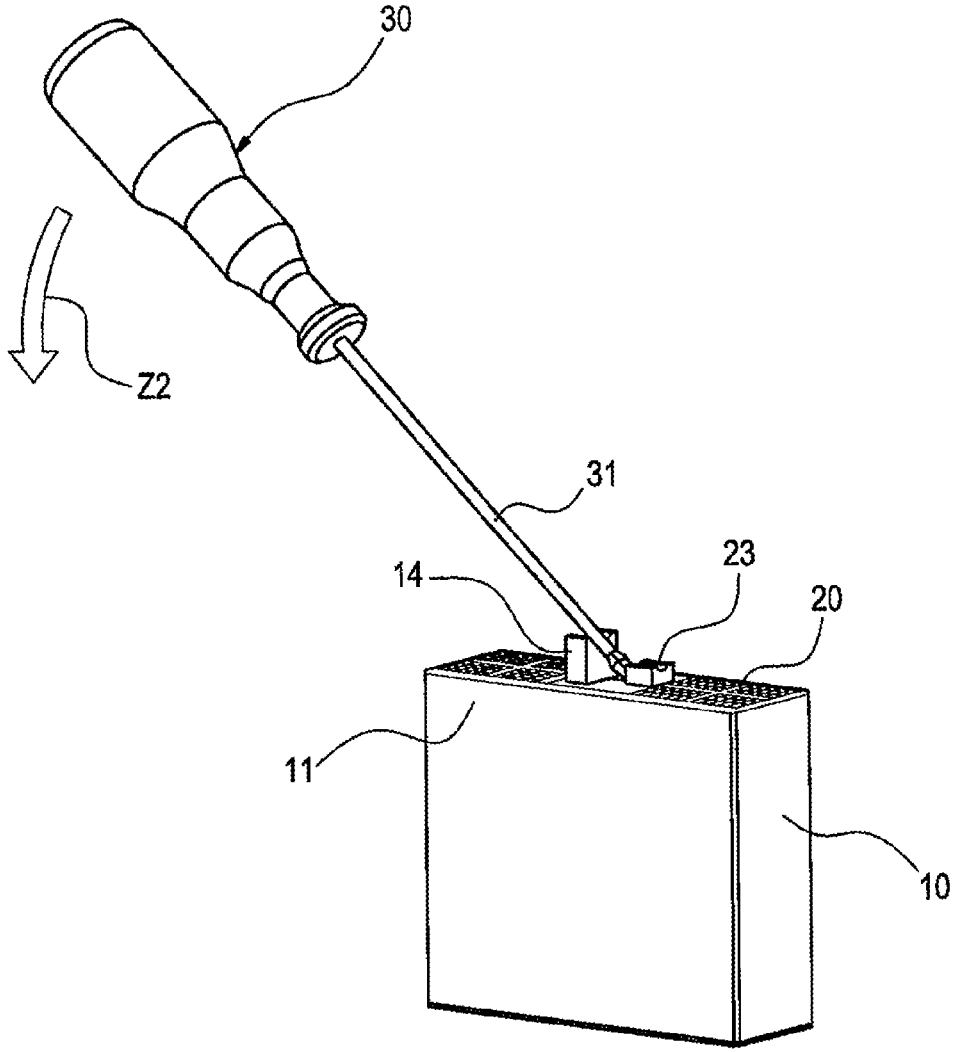
FIG. 5 is an explanatory view of a method for releasing the connector housings of the connector of the embodiment from a state of fit-connection by means of the rod-shaped member.

The method for releasing the male connector housing 10 and the female connector housing 20 from a fitted state is now described by reference to FIGS. 5 and 6.

In this case, as shown in FIG. 6, the tip of the shaft 31 of the driver 30 is inserted into the second recess 25 while the male connector housing 10 and the female connector housing 20 are fit-connected together, and the exterior surface of the middle portion of the shaft 31 is brought into contact with the second contact surface 16. As designated by arrow Z2 in FIG. 5, the base end of the driver 30 is pressed down.

As shown in FIG. 6, as a result of depression of the driver 30, a downward push load designated by arrow Y4 acts on the first projection 14, and a push-up load designated by arrow Y5 acts on the second projection 23. Thereupon, the male connector housing 10 and the female connector housing 20 each move in a direction of disengagement, so that the male connector housing 10 is disengaged from the female connector housing 20.

Specifically, in the connector 1 of the embodiment, the shaft 31 of the driver 30, whose tip is inserted into the second recess 25 while the male connector housing 10 and the female connector housing 20 remain fit-connected to each other, with the exterior surface of its middle portion remaining in contact with the second contact surface 16 is utilized as a lever for disengaging the male connector housing 10 from the female connector housing 20.

In the connector 1 of the embodiment that has been described above, the shaft 31 of the driver 30, whose tip is inserted into the first recess 15 while the male connector housing 10 and the female connector housing 20 remain located at the fit starting position, with the exterior surface of its middle portion remaining in contact with the first contact surface 24 acts as a lever that pushes the male connector housing 10 into the female connector housing 20 when a base end of the lever is pushed down. As in the case with the lever connector, an insertion force required to bring the male connector housing 10 and the female connector housing 20 into a fit-connected state can be lessened.

The shaft 31 of the driver 30 is member which differs from the male connector housing 10 and the female connector housing 20 that make up the connector 1, and can be handled and utilized as a different tool. The shaft 31, as distinct from a lever that is previously accommodated in a connector housing, also does not incur an increase in the number of fabrication processes. Moreover, the shaft 31 of the driver 30 is a tool differing from the male connector housing 10 and the female connector housing 20. Therefore, even when the length of the shaft 31 is made longer in order to obtain a desired leverage, an increase in the size of the connector 1 is not caused. An increase in leverage makes it possible to make an insertion force much smaller and miniaturize the connector 1.

Accordingly, a fit connection between the male connector housing 10 and the female connector housing 20 can be made with an insertion force that is equal to or smaller than that required by the lever connector without incurring an increase in the number of fabrication processes, and miniaturization of the connector can also be sought.

Also, in the connector 1 of the embodiment that has been described thus far, the first projection 14 penetrates through the substantial center of the female connector housing 20. During manipulation for causing the shaft 31 of the driver 30 to act as a lever member to thereby make a fit connection between the male connector housing 10 and the female connector housing 20, the load exerted by the shaft 31 of the driver 30 on the male connector housing 10 in the fitting direction by way of the first projection 14 acts on the substantial center of the male connector housing 10 that is the location where the first projection 14 is mounted.

Therefore, occurrence of an inclination or a twist in the male connector housing 10 is prevented, thereby making it possible to make mutual fitting of the male connector housing 10 and the female connector housing 20 smooth.

In the connector 1 of the embodiment that has been described above, when a downward push is given to the base end of the shaft 31 of the driver 30, whose tip is inserted into the second recess 25 while the male connector housing 10 and the female connector housing 20 remain fit-connected to each other, with the exterior surface of its middle portion remaining in contact with the second contact surface 16, the shaft 31 acts as a lever for releasing the male connector housing 10 and the female connector housing 20 from the fitted state. As in the case with the lever connector, a manipulation force required to release the male connector housing 10 and the female connector housing 20 from the engaged state can be lessened.

In the connector 1 of the embodiment that has been described thus far, the driver 30 that is a general purpose tool is used as a rod-shaped member to be used for bringing or releasing the male connector housing 10 and the female connector housing 20 into or from a fitted state. Therefore, a necessity to design and manufacture a custom-designed rod-shaped member is obviated, so that an increase in the number of constituent parts of the connector 1 can be prevented.

The connector 1 of the present invention is not limited to the embodiment and is susceptible to appropriate alterations or modifications.

For instance, in the embodiment, the male connector housing 10 is equipped with the first projection 14, and the female connector housing 20 is equipped with the second projection 23. Conversely, the female connector housing 20 can also be equipped with the first projection 14 that penetrates through the male connector housing 10, and the second projection 23 can also be mounted on a rear end side of the male connector housing 10.

In addition, so long as the objective of the present invention is accomplished, the shapes, dimensions, and locations of the first projection 14 and the second projection 23 exemplified in connection with the embodiment are arbitrary and not restricted to those mentioned in connection with the embodiment.

The patent application is based on Japanese Patent Application (JP-2010-285090) filed on Dec. 21, 2010, the subject matter of which is incorporated herein by reference in its entirety.

INDUSTRIAL APPLICABILITY

The connector of the present invention enables miniaturization of a connector as well as making of a fit connection between connector housings with an insertion force that is equal to or smaller than an insertion force required by a lever connector without incurring an increase in the number of constituent parts or the number of fabrication processes.

DESCRIPTIONS OF THE REFERENCE NUMERALS AND SYMBOLS

1 CONNECTOR
10 MALE CONNECTOR HOUSING (ONE CONNECTOR HOUSING)
14 FIRST PROJECTION
**14*a*** LEADING END
15 FIRST RECESS
16 SECOND CONTACT SURFACE
20 FEMALE CONNECTOR HOUSING (THE OTHER CONNECTOR HOUSING)
**20*b*** REAR END
22 SHAFT INSERT HOLE
23 SECOND PROJECTION
24 FIRST CONTACT SURFACE
25 SECOND RECESS
30 DRIVER
31 SHAFT (ROD-SHAPED MEMBER)

The invention claimed is:

1. A connector, comprising:

a pair of a male connector housing and a female connector housing to be fit-connected together;

wherein one of the pair of the male connector housing and the female connector housing has:

a first projection projectingly provided in a direction in which the connector housings are fitted together such that a leading end of the first projection projects from a rear end of the other connector housing to a rear when the one connector housing is placed at a location where the one connector housing starts to fit into the other connector housing, and a first recess that is formed in the leading end of the first projection so that a tip of another rod-shaped member can be inserted in a direction which crosses substantially at right angles a direction in which the connector housings are fitted together; wherein the other connector housing has a second projection that is provided so as to project from a rear end of the other connector housing in a rear so as to oppose the leading end of the first projection in a direction that is substantially orthogonal to the direction in which the connector housings are fitted together when the other connector housing is positioned at the location where the one connector housing starts to fit into the other connector housing, and a first contact surface that is formed on a leading end of the second projection such that an exterior surface of a middle portion of the rod-shaped member whose tip is inserted into the first recess can contact the first contact surface; and wherein the rod-shaped member whose tip is inserted into the first recess with the exterior surface of the middle portion of the rod-shaped member remaining in contact with the first contact surface while the connector housings are placed at a fit starting position is utilized as a lever for making a fit between the connector housings.

2. The connector according to claim 1, wherein the first projection is mounted so as to project toward a rear end of the other connector housing while penetrating through a shaft insert hole formed, in a piercing manner, in substantially a center of the other connector housing.

3. The connector according to claim 1, wherein the first recess and the first contact surface each are formed so that a driver which is a general purpose tool can be used as the rod-shaped member.

4. The connector according to claim 1, wherein a second recess that allows insertion of the tip of the rod-shaped member in a direction which crosses a direction in which the connector housings are fit-connected together is formed in the leading end of the second projection;

a second contact surface that is provided in a leading end of the first projection and that the exterior surface of the middle portion of the rod-shaped member can contact when the tip is inserted into the second recess; and the rod-shaped member, whose tip is inserted into the second recess while the connector housings remain in a fit-connected state, with the exterior surface of the middle portion of the rod-shaped member remains in contact with the second contact surface is utilized as a lever for releasing the connector housings from the fit-connected state.

5. The connector according to claim 4, wherein the first recess, the first contact surface, the second recess, and the second contact surface are formed so that a driver which is a general purpose tool can be used as the rod-shaped member.

* * * * *